United States Patent [19]

Loyd

[11] 4,270,270

[45] Jun. 2, 1981

[54] COMBINATION POWER SAW AND CHAIN SAW AND ADAPTER DEVICE AND METHODS OF MAKING AND USING THE SAME

[76] Inventor: Ellis R. Loyd, Rte. 2, Box 474A Shackelford Rd., Florissant, Mo. 63034

[21] Appl. No.: 953,755

[22] Filed: Oct. 23, 1978

Related U.S. Application Data

[63] Continuation-in-part of Ser. No. 761,274, Jan. 21, 1977, Pat. No. 4,121,336.

[51] Int. Cl.[3] ..... B27B 17/00

[52] U.S. Cl. ..... 30/122; 30/386

[58] Field of Search ..... 30/122, 383, 385, 386

[56] References Cited

U.S. PATENT DOCUMENTS

| | | | |
|---|---|---|---|
| 2,839,097 | 6/1958 | Siria | 30/122 |
| 2,860,671 | 11/1958 | Wilder | 30/122 |
| 2,879,814 | 3/1959 | Scott | 30/122 |
| 4,033,035 | 7/1977 | Trimmer | 30/122 |
| 4,121,336 | 10/1978 | Loyd | 30/122 |

*Primary Examiner*—Jimmy C. Peters

[57] ABSTRACT

The present invention relates to a combination hand held circular saw and chain saw and an adapter to convert a conventional hand held circular saw to a chain saw comprising a hand held power means which includes housing means provided with handle means, motor means mounted in paid housing means said motor means provided with shaft means, and a surface plate operably mounted on said housing means, in combination with frame means, said frame means comprising an alignment plate, chain saw housing means and alignment means, sprocket means operably mounted on said motor shaft means, chain saw frame means adjustably mounted to said frame means and chain saw means.

3 Claims, 9 Drawing Figures

COMBINATION POWER SAW AND CHAIN SAW AND ADAPTER DEVICE AND METHODS OF MAKING AND USING THE SAME

BACKGROUND OF THE INVENTION

This application is a continuation in part of application No. 761,274, filed, Jan. 21, 1977.

Commercially available hand held power saw generally available at the present time include circular saws and chain saws. A great demand exists for these devices in portable configuration to allow for greater efficiency in the uses of such devices.

An advantage to be gained from the present invention is to eliminate the present necessity of carrying two separate devices. This entails carrying the entire power source for both units.

SUMMARY

It is therefore an object of the present invention to provide a combination circular saw and chain saw device which will allow the user to simply, easily and quickly convert his device from a circular saw to a chain saw and vice versa. It is contemplated that the device will include a conventional housing, motor and surface frame in combination with either the circular saw blade or in combination with the adapter which includes the second frame, the sprocket means and chain saw means.

An object of the present invention is to provide such a device which may be powered by various types of motors and engines including gasoline and electric engines and motors.

A further object of the present invention is to provide such a device which is simply and economically manufactured and used.

These together with other objects and advantages which will become subsequently apparent, reside in the details and construction and operation as more fully hereinafter described and claimed, reference being had to the accompanying drawings forming a part hereof, wherein like numerals refer to like parts throughout, and in which;

DETAILED DESCRIPTION OF THE INVENTION

Figure 1:
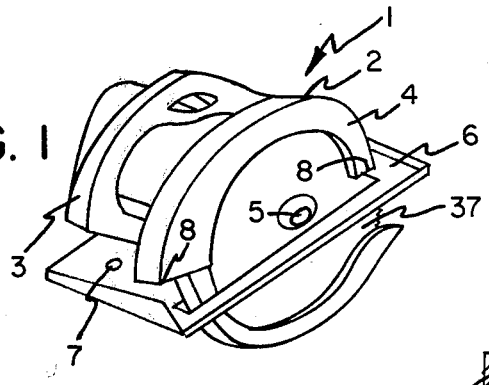
FIG. 1 is a perspective view of a hand saw device constructed in accordance with and embodying the present invention.
Figure 5:
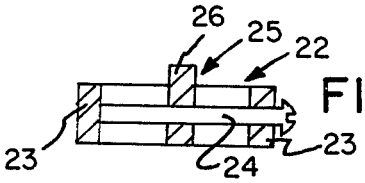
FIG. 5 is a partial sectional view of the frame means in FIG. 2.

Referring now in more detail and by reference characters to the drawings which illustrate practical embodiments of the present invention, FIG. 1, is a perspective view of a hand saw unit, 1, constructed in accordance with, used in, and embodying the present invention.

As shown in FIG. 1, hand saw unit, 1, comprises housing means, 2, provided with handle means, 3, blade guard, 4, motor shaft, 5, and surface plate, 6, which is provided with holes, 7. In the embodiment shown, guard, 4, has been provided with aligned surfaces, 8.

Shown in FIGS. 2, 3, 4, and 5, is frame unit, 9, which includes alignment plate, 10, provided with holes, 11, which align with holes, 7, when the device is assembled. Blade guard, 12, is provided with aperture, 13, through which shaft, 5, is extended and alignment blocks, 14, and, 15, which align with surfaces, 8, when the device is assembled. In the embodiment shown blade guard, 12, is provided with mounting posts, 16, to which frame plate, 17, is attached and alignment bar, 18, which is disposed within slot, 19, in guide bar, 20, when the device is assembled. Frame plate, 17, which is attached to frame, 9, is provided with handle means, 21, and guide bar adjustment, 22. Guide bar adjustment, 22, comprises housing, 23, screw means, 24, and projection means, 25. Projection means, 25, is provided with tip, 26, which is disposed in the circular portion, 27, of slot, 19, in guide bar, 20, when the device is assembled. Adjusting screw means, 24, thereby performs the function of moving guide gar, 20, toward and away from shaft, 5, thus increasing or decreasing the tension on chain, 28, shown functionally in FIG. 7.

It is readily apparent that for use as a circular saw, one simply installs the circular blade, 37, on housing, 30. Assembly of device, 1, for use as a chain saw consists of first removing the nut or other fastener from shaft, 5, and then removing blade, 37. The saw unit is then placed on plate, 10, such that the lower guard is pushed up into guard, 4, and shaft, 5, extends through aperture, 13, surfaces, 8, rest on blocks, 14, and, 15, and holes, 7, align with holes, 17.

Figure 6:
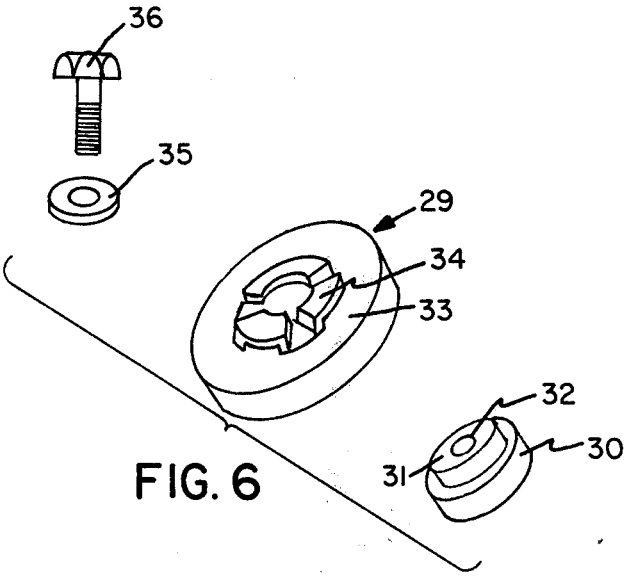
FIG. 6 is a partial perspective view of the sprocket means constructed in accordance with and used in the present invention.
Figure 7:
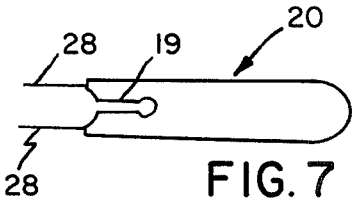
FIG. 7 is a partial elevation view of a chain saw constructed in accordance with and used in the present invention.

The parts illustrated in FIG. 6, provide a means for using a conventional power saw and a commercially available chain saw guide bar, 20. Housing, 30, is first placed on shaft, 5, then sprocket bearing unit, 29, which comprises sprocket, 34, mounted in bearing unit, 33, is placed on housing, 30, with the shaped portions aligning with same and sprocket bearing unit, 29, is secured to shaft, 5, by bolt, 36, and washer, 35, and chain, 28, in FIG. 7 is then extended over sprocket, 34, and guide bar, 20, is placed in guard, 12, such that bar, 18, extends into slot, 19. Guide bar, 20, which is commercially available is shown to have chain portions, 28, which extend to the left to engage sprocket, 34. Not shown in FIG. 7, within guide bar, 20, and proximate the right end thereof is another sprocket, not shown, about which, 28, is engaged. Sprocket bearing unit, 29, is disposed within housing projection, 38. Wire brush, 39, may be installed and disposed to clean chain, 28, and lubricant dispenser, 40, may be provided where trigger, 41, causes reservoir, 42, to be squeezed and dispense lubricant which strikes funnel, 43, and drops to chain, 28.

Having installed guide bar, 20, then plate, 17 is installed to guard, 12, by screws (not shown) in plate, 17, which secure to threaded holes (not shown) in posts, 16, in frame, 12, and aligned such that projection, 25, extends into circular portion, 27, on guide bar, 20, and thereby controls the tension on chain, 28.

Figure 9:
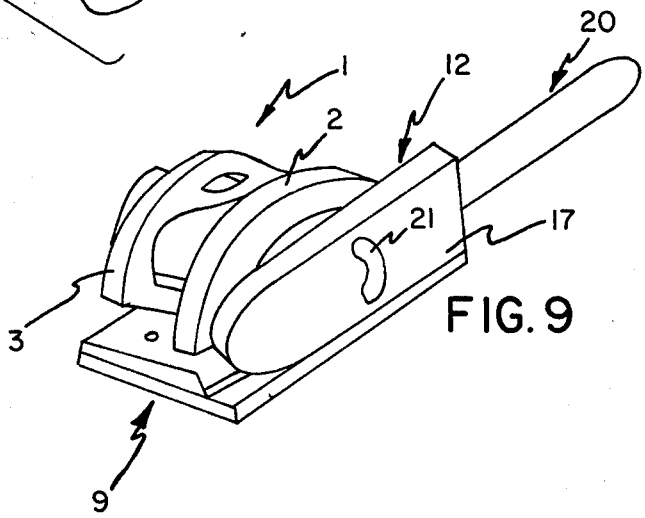
FIG. 9 is another perspective view of the hand saw device constructed in accordance with and embodying the present invention.
Figure 2:
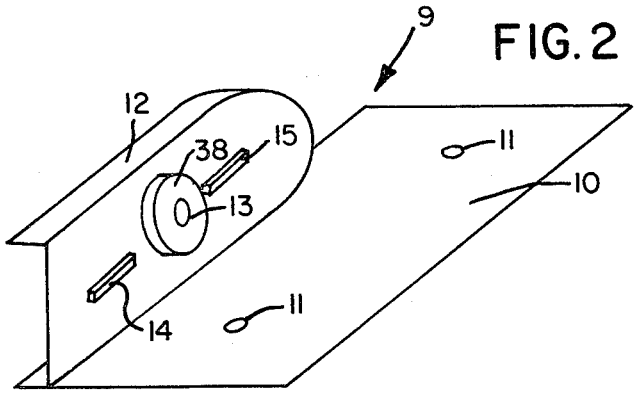
FIG. 2 is a perspective view of a frame means constructed in accordance with and used in the present invention.
Figure 3:
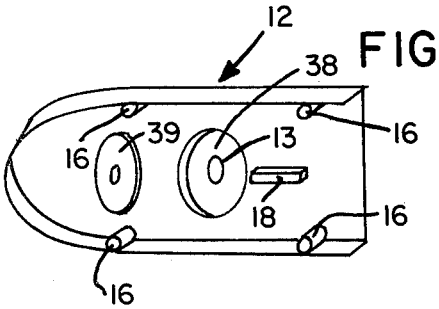
FIG. 3 is a partial perspective view of the frame means in FIG. 2.
Figure 8:
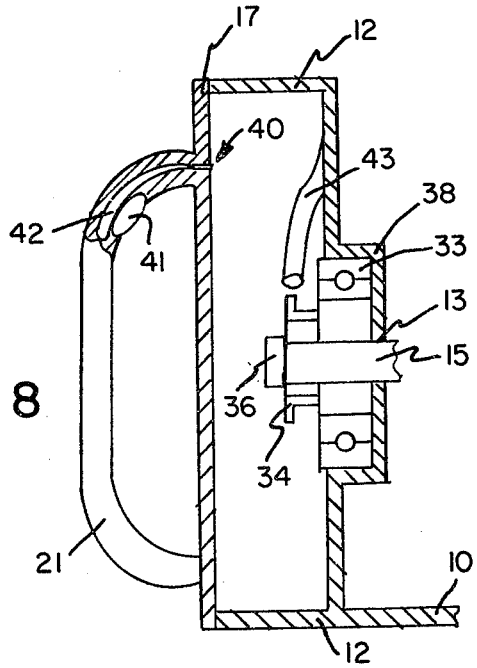
FIG. 8 is a partial sectional view of a portion of the device shown in FIG. 1 with the chain saw assembled.
Figure 4:
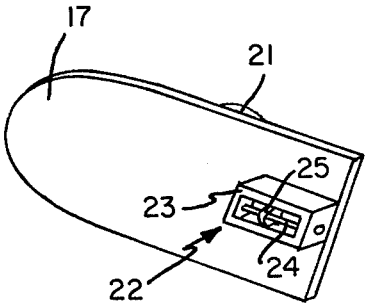
FIG. 4 is a perspective view of a frame plate for use with the frame means in FIG. 2.

FIG. 8 illustrates the assembled interrelationships between the various elements of device, 1. FIG. 9 illustrates perspectively assembled interrelationship between the various elements of device, 1, for use as a chain saw.

It should be understood that changes and modifications in the form, construction, arrangement, and combination of the combination circular and chain saw device and methods of making and using the same may be made and substituted for those herein shown and described without departing from the nature and principle of my invention.

Having thus described my invention, what I claim is new and desire to secure by United States Letters Patent is:

1. A circular saw adapter to convert a circular saw provided with housing means, and motor means including a motor driven blade supporting shaft and a surface plate substantially parallel to said shaft into a chain saw, comprising, frame means operably mounted to said surface plate, said frame means comprising, plate means, chain saw housing means mounted on said plate means, and provided with an aperture therein which when said plate is secured to said surface plate in a parallel relationship said aperture will be disposed in alignment with said shaft and said shaft will extend through said aperture, said housing provided with a removable frame plate which when mounted thereon forms a chain saw chamber within said frame means which communicates to the exterior through an opening in said frame means, said chain saw housing means provided with a bearing housing, guide bar adjust means operably mounted on said frame plate mounting means operably mounted on said shaft; said mounting means (operated) which is mounted on said shaft comprising bearing means provided with sprocket means mounted thereon, securing means to secure said sprocket and mounting means to said shaft, a chain saw guide bar operably mounted to said frame means, and handle means.

2. A circular saw adapter as described in claim 1 wherein said chain saw housing means is provided with lubricant dispensing means.

3. A circular saw adapter as described in claim 1 wherein said chain saw housing means is provided with wire brush means disposed proximate said sprocket means.

* * * * *